US008980791B2

(12) United States Patent
Matsumoto

(10) Patent No.: US 8,980,791 B2
(45) Date of Patent: Mar. 17, 2015

(54) THERMAL RECORDING MATERIAL AND METHOD FOR PRODUCING THE SAME

(75) Inventor: Shinichiro Matsumoto, Tokyo (JP)

(73) Assignee: Mitsubishi Paper Mills Limited, Tokyo (JP)

( * ) Notice: Subject to any disclaimer, the term of this patent is extended or adjusted under 35 U.S.C. 154(b) by 48 days.

(21) Appl. No.: 13/982,852

(22) PCT Filed: Feb. 14, 2012

(86) PCT No.: PCT/JP2012/053340

§ 371 (c)(1),
(2), (4) Date: Sep. 17, 2013

(87) PCT Pub. No.: WO2012/124419

PCT Pub. Date: Sep. 20, 2012

(65) Prior Publication Data

US 2014/0005046 A1 Jan. 2, 2014

(30) Foreign Application Priority Data

Mar. 11, 2011 (JP) ..... 2011-054060

(51) Int. Cl.
*B41M 5/42* (2006.01)
*B41M 5/44* (2006.01)

(52) U.S. Cl.
CPC . *B41M 5/42* (2013.01); *B41M 5/44* (2013.01); *B41M 2205/04* (2013.01); *B41M 2205/40* (2013.01)
USPC ..... 503/226; 503/200; 427/152

(58) Field of Classification Search
CPC ..... B41M 5/42; B41M 5/44; B41M 2205/04; B41M 2205/40
USPC ..... 503/200, 226; 427/152
See application file for complete search history.

(56) References Cited

U.S. PATENT DOCUMENTS

2010/0209723 A1 8/2010 Tanaka et al.

FOREIGN PATENT DOCUMENTS

| | | |
|---|---|---|
| JP | 2002-301868 | 10/2002 |
| JP | 2010-077385 | 4/2010 |
| JP | 2010-217681 | 9/2010 |
| JP | 2011-213089 | * 10/2011 |
| JP | 2011-235545 | * 11/2011 |
| WO | 2009/028646 | 3/2009 |

* cited by examiner

*Primary Examiner* — Bruce H Hess
(74) *Attorney, Agent, or Firm* — Fitzpatrick, Cella, Harper & Scinto

(57) ABSTRACT

Provided is a thermal recording material that is excellent in water resistance and prevention of print head wear, less prone to discoloration in the non-printing area, and stably producible. The thermal recording material comprises a protective layer formed by applying a coating liquid for forming the protective layer, the coating liquid being prepared by mixing an acetoacetyl-modified polyvinyl alcohol and calcium glyoxylate particles with a maximum diameter less than 500 μm and an average diameter of 125 μm or less.

6 Claims, No Drawings

THERMAL RECORDING MATERIAL AND METHOD FOR PRODUCING THE SAME

TECHNICAL FIELD

The present invention relates to a thermal recording material comprising a heat-sensitive recording layer for color formation by heat and a protective layer stacked in this order on a support. Specifically, the present invention relates to a thermal recording material that is excellent in water resistance, less prone to discoloration in the non-printing area, and stably producible, and a method for producing the same.

BACKGROUND ART

Generally, thermal recording materials comprise, on a support, a heat-sensitive recording layer containing, as main components, an electron-donating dye precursor, which is usually colorless or light-colored, and an electron-accepting compound. By application of heat to such thermal recording materials with a thermal print head, a thermal stylus, laser beam, etc., an instant reaction between the electron-donating dye precursor and the electron-accepting compound serving as a color developer occurs and thereby a recorded image is produced thereon. Such thermal recording materials are advantageous, for example, in that records can be made thereon with a relatively simple device ensuring easy maintenance and no noise generation, and therefore are widely used for measuring recorders, facsimiles, printers, computer terminals, label printers, ticket machines for passenger tickets or other tickets, and the like. Particularly in recent years, thermal recording materials are also used as receipts of gas, water, electricity and other bill payments, billing statements issued from ATMs at financial institutions, various receipts, public lotteries, thermal recording labels or tags for point of sales (POS) system, etc.

With the advance of thermal recording systems, thermal recording materials are used under severer conditions. In particular, for use under wet conditions, thermal recording materials comprising a protective layer with excellent water resistance are strongly desired.

For improvement in water resistance of thermal recording materials, as a protective layer formed on a heat-sensitive recording layer, various protective layers having different components are proposed. Among these, protective layers in which an acetoacetyl-modified polyvinyl alcohol is used have been known and are disclosed in, for example, JP-A 10-151855, JP-A 10-151856, JP-A 2004-358762, etc. As a crosslinker used in combination with the acetoacetyl-modified polyvinyl alcohol, a vinyl sulfone compound is disclosed in JP-A 2004-034436, a hydrazide compound is disclosed in JP-A 2004-249528, sebacic acid dihydrazide and dodecanedioic acid dihydrazide are disclosed in JP-A 2006-212975, an amino-containing silane coupling agent is disclosed in JP-A 2009-039874, a particular kind of aldehyde compound is disclosed in JP-A 2009-113438, and a dicarboxylic acid dihydrazide is disclosed in JP-A 2009-214422. However, such protective layers are disadvantageous in that the non-printing area of thermal recording materials may discolor under hot and humid conditions, and in that a coating liquid for forming the protective layer becomes viscous after preparation and before application, thereby hindering stable production of thermal recording materials. Thus, there is need for improvement.

Further, as thermal recording materials that excel in water resistance and discoloration resistance, thermal recording materials comprising a protective layer having crosslinks formed by a glyoxylate and a particular kind of glyoxylic acid ester derivative are disclosed in Patent Literature 1 and 2, but water resistance of these thermal recording materials is still unsatisfactory and there is need for further improvement. As a glyoxylate used as a crosslinker for acetoacetyl-modified polyvinyl alcohols, sodium glyoxylate, magnesium glyoxylate and the like are also known, but in the case of use of sodium glyoxylate, sodium ions may cause wear of thermal print heads and print failure, and in the case of use of magnesium glyoxylate, water resistance is insufficient.

CITATION LIST

Patent Literature
Patent Literature 1: WO 09/028,646
Patent Literature 2: JP-A 2010-077385

SUMMARY OF INVENTION

Technical Problem

An object of the present invention is to provide a solution to the problems described above, namely to provide a thermal recording material that is excellent in water resistance and prevention of print head wear, less prone to discoloration in the non-printing area, and stably producible.

Solution to Problem

The above-mentioned object can be basically achieved by a thermal recording material comprising, as essential layers, a heat-sensitive recording layer for color formation by heat and a protective layer stacked in this order on a support, the protective layer being formed by applying a coating liquid for forming the protective layer, the coating liquid being prepared by mixing an acetoacetyl-modified polyvinyl alcohol and calcium glyoxylate particles with a maximum diameter less than 500 μm and an average diameter of 125 μm or less.

The coating liquid for forming the protective layer preferably further contains an epichlorohydrin resin and the average diameter of the calcium glyoxylate particles is preferably 85 μm or less.

Further, the above-mentioned object can be basically achieved by a method for producing a thermal recording material comprising, as essential layers, a heat-sensitive recording layer for color formation by heat and a protective layer stacked in this order on a support, the method comprising the steps of: preparing a coating liquid for forming the protective layer by mixing an acetoacetyl-modified polyvinyl alcohol and calcium glyoxylate particles with a maximum diameter less than 500 μm and an average diameter of 125 μm or less, and applying the coating liquid to form the protective layer.

Advantageous Effects of Invention

The present invention can provide a thermal recording material that is excellent in water resistance and prevention of print head wear, less prone to discoloration in the non-printing area, and stably producible.

DESCRIPTION OF EMBODIMENTS

Hereinafter, the present invention will be described in detail.

As used herein, the acetoacetyl-modified polyvinyl alcohol refers to a polyvinyl alcohol having an acetoacetyl group introduced in the side chain. The average polymerization degree, the saponification degree and the modification degree of the acetoacetyl-modified polyvinyl alcohol are not particularly limited, but in view of solubility, ease of coating, water resistance of the coat, layer strength and the like, the average polymerization degree is preferably 500 or higher but lower than 4000, the saponification degree is preferably 90% or higher, and the modification degree is preferably about 1 to 10 mol %. According to the present invention, the acetoacetyl-modified polyvinyl alcohol content of the protective layer is preferably 20 to 80% by mass, and particularly preferably 30 to 60% by mass relative to the total solid content of the protective layer.

In the present invention, calcium glyoxylate is used as a glyoxylate for crosslinking of the above-described acetoacetyl-modified polyvinyl alcohol. As a glyoxylate used for this purpose, a sodium or magnesium salt of glyoxylic acid besides a calcium salt thereof is also known to be usable, but as shown in the Examples below, the sodium salt causes wear of thermal print heads and the magnesium salt cannot provide sufficient water resistance.

Calcium glyoxylate can be preferably used for thermal recording materials as mentioned above, but due to its solidity and poor water solubility, is not sufficiently reactive as a crosslinker for acetoacetyl-modified polyvinyl alcohols, and thus is unsatisfactory for providing sufficient water resistance.

In the present invention, for improved reactivity of calcium glyoxylate as a crosslinker for acetoacetyl-modified polyvinyl alcohols and for sufficient water resistance, the maximum diameter of the calcium glyoxylate particles used in the preparation of a coating liquid is less than 500 μm and the average diameter thereof is 125 μm or less. Calcium glyoxylate particles more than 125 μm in average diameter will be dissolved by thorough mixing in the coating liquid, but cannot provide sufficient water resistance, and thus are not preferred. In the preparation of the coating liquid, calcium glyoxylate particles containing coarse particles of 500 μm or more in maximum diameter will be dissolved by thorough mixing in the coating liquid, but cannot provide sufficient water resistance, and thus are not preferred. To confirm that the maximum particle diameter is less than 500 μm, a method comprising sieving particles through a mesh with 500-μm openings and checking the presence or absence of residual particles on the mesh can be employed. For further improved water resistance, it is preferred that the average diameter of calcium glyoxylate particles is 85 μm or less. However, when calcium glyoxylate particles are too finely-ground, there is little effect on improvement of water resistance, and there is only increase in energy cost for fine grinding. Thus, it is preferred that the lower limit of the average diameter of calcium glyoxylate particles is 1.0 μm. The average particle diameter as used herein is a value of the volume-average particle diameter calculated based on particle size distribution measurement using the laser diffraction/scattering method. Specifically, such a measurement can be done with the use of Microtrac series manufactured by Nikkiso Co., Ltd., LA series manufactured by Horiba, Ltd., SALD series manufactured by Shimadzu Corporation, LS series manufactured by Beckman Coulter, etc.

For size adjustment of the calcium glyoxylate particles of the present invention, i.e., for preparation of calcium glyoxylate particles with a maximum diameter less than 500 μm and an average diameter of 125 μm or less, for example, a dry grinding mill can be used. For the same purpose, a wet grinding mill can also be used. Specific examples of the dry grinding mill include Drystar SDA manufactured by Ashizawa Finetec Ltd.; Dynamic Mill, Attritor, Fine Mill and Stream Mill manufactured by NIPPON COKE & ENGINEERING CO., LTD.; Turbo Mill and Smooth Mill manufactured by FREUND-TURBO CORPORATION; Nano Jetmizer manufactured by Aishin Nano Technologies CO., LTD.; and Counter Jet Mill and Inomizer manufactured by Hosokawa Micron Corporation. According to the present invention, the calcium glyoxylate content is preferably 0.5 to 20% by mass, and particularly preferably 3 to 10% by mass relative to the acetoacetyl-modified polyvinyl alcohol content.

In the protective layer of the present invention, a crosslinker other than calcium glyoxylate can be further contained unless the desired effects of the present invention are hindered. Specific examples of such a crosslinker include glyoxal, epichlorohydrin resins, boron compounds such as boric acid and borax, divalent or higher polyvalent metal compounds such as zirconium, titanium and aluminum, hydrazide compounds, amine compounds, epoxy compounds, N-methylol compounds, aziridine compounds and oxazoline compounds. Among these, epichlorohydrin resins can further improve water resistance of thermal recording materials.

Examples of the epichlorohydrin resin include polyamide-epichlorohydrin resins and polyamine-epichlorohydrin resins. The specific examples include WS4020, WS4024, WS4030 and CP8970 manufactured by SEIKO PMC CORPORATION, and Sumirez Resins 650(30) and 675A manufactured by Taoka Chemical Co., Ltd. (these are all polyamide-epichlorohydrin resins); and WS4010 and WS4011 manufactured by SEIKO PMC CORPORATION (both are polyamine-epichlorohydrin resins). Among these, polyamide-epichlorohydrin resins are preferred because they can prevent thickening of the coating liquid and thereby further improve stability thereof. According to the present invention, the epichlorohydrin resin content is preferably 0.5 to 30% by mass, and particularly preferably 3 to 20% by mass relative to the acetoacetyl-modified polyvinyl alcohol content.

The protective layer of the present invention can contain a pigment. Examples of the pigment include inorganic pigments such as diatomite, talc, kaolin, calcined kaolin, heavy calcium carbonate, light calcium carbonate, magnesium carbonate, zinc oxide, aluminum oxide, aluminum hydroxide, magnesium hydroxide, titanium dioxide, barium sulfate, zinc sulfate, amorphous silica, amorphous calcium silicate and colloidal silica; and organic pigments such as melamine resins, urea-formalin resins, polyethylene, nylon, styrene plastic pigments, acrylic plastic pigments and hydrocarbon plastic pigments. Among these, pigments having a tabular structure, such as kaolin and aluminum hydroxide, are preferably used. The pigment content is preferably 10 to 70% by mass relative to the total solid content of the protective layer.

In the protective layer of the present invention, an adhesive other than the above-mentioned acetoacetyl-modified polyvinyl alcohol can be further used unless the desired effects of the present invention are hindered. Specific examples of such an adhesive include water soluble resins such as fully- or partially-saponified polyvinyl alcohols, diacetone-modified polyvinyl alcohols, carboxy-modified polyvinyl alcohols, silicon-modified polyvinyl alcohols, hydroxyethyl cellulose, methyl cellulose, carboxymethyl cellulose, gelatin, casein, alkali salts of styrene/maleic anhydride copolymers, alkali salts of ethylene/acrylic acid copolymers and alkali salts of styrene/acrylic acid copolymers; and hydrophobic resins such as styrene/butadiene latex, acrylic latex and urethane latex. The amount of such an additional adhesive is preferably 30% by mass or less, and more preferably 15% by mass or less relative to the acetoacetyl-modified polyvinyl alcohol content.

The coating liquid for forming the protective layer according to the present invention can be obtained by mixing an acetoacetyl-modified polyvinyl alcohol with calcium glyoxylate particles with a maximum diameter less than 500 μm and an average diameter of 125 μm or less, and if needed other components, in an aqueous medium. For example, the mixing is preferably performed as follows: water soluble components of the coating liquid are optionally dissolved in separate aqueous media in advance, all the components are added to an aqueous medium, and stirring is performed using a stirring means, such as a homo mixer and a homogenizer, for at least 30 minutes, more preferably 60 to 120 minutes while the solution temperature is maintained at 10 to 40° C. The aqueous medium refers to a liquid medium mainly containing water (the water content of the medium is 50% by mass or more) and if needed further containing a water-miscible solvent such as ethanol. Hereinafter, liquid materials expressed as "aqueous" represent materials containing an aqueous medium as a medium.

The protective layer of the present invention can be formed by applying the above-described coating liquid for forming the protective layer. Specifically, the application of the coating liquid can be performed by various techniques such as film press coating, air knife coating, rod blade coating, bar coating, blade coating, gravure coating, curtain coating and extrusion bar coating, or with the use of various printers etc. such as lithographic printers, letterpress printers, flexographic printers, gravure printers, screen printers and hotmelt printers. Further, for formation of the protective layer, either of the following procedures may be employed: the coating and drying for forming the protective layer are performed after the coating and drying for forming the heat-sensitive recording layer; and after simultaneous coating for forming all the layers including the heat-sensitive recording layer and optional layers as well as the protective layer (simultaneous multilayer coating by slide curtain coating etc.), drying is performed. The bone-dry coating amount for forming the protective layer is preferably 0.2 to 10 g/m$^2$, and more preferably 1 to 5 g/m$^2$.

The heat-sensitive recording layer according to the present invention can be obtained by mixing aqueous dispersions of finely-ground components needed for color formation, with a resin and the like; and applying and drying the resulting mixture on the support.

The electron-donating compound which is contained as a dye precursor in the heat-sensitive recording layer and is usually colorless or light-colored is not particularly limited, and is typified by substances generally used in pressure-sensitive recording materials and thermal recording materials.

Specific examples of the dye precursor include the following:

(1) Triarylmethane Compounds 3,3-bis(p-dimethylaminophenyl)-6-dimethylamino-phthalide (crystal violet lactone), 3,3-bis(p-dimethylaminophenyl)phthalide, 3-(p-dimethylaminophenyl)-3-(1,2-dimethylindol-3-yl)phthalide, 3-(p-dimethylaminophenyl)-3-(2-methylindol-3-yl)phthalide, 3-(p-dimethylaminophenyl)-3-(2-phenylindol-3-yl)phthalide, 3,3-bis(1,2-dimethylindol-3-yl)-5-dimethylamino-phthalide, 3,3-bis(1,2-dimethylindol-3-yl)-6-dimethylamino-phthalide, 3,3-bis(9-ethylcarbazol-3-yl)-5-dimethylamino-phthalide, 3,3-bis(2-phenylindol-3-yl)-5-dimethylamino-phthalide, 3-p-dimethylaminophenyl-3-(1-methylpyrrol-2-yl)-6-dimethyl-amino-phthalide, and the like;

(2) Diphenylmethane Compounds 4,4'-bis(dimethylaminophenyl)benzhydrylbenzyl ether, N-chlorophenylleucoauramine, N-2,4,5-trichlorophenylleucoauramine, and the like;

(3) Xanthene Compounds rhodamine B anilinolactam, rhodamine B-p-chloroanilinolactam, 3-diethylamino-7-dibenzylaminofluoran, 3-diethylamino-7-octylaminofluoran, 3-diethylamino-7-phenylfluoran, 3-diethylamino-7-chlorofluoran, 3-diethylamino-6-chloro-7-methylfluoran, 3-diethylamino-6-methyl-7-(3-methylphenylamino)fluoran, 3-diethylamino-7-(3,4-dichloroanilino)fluoran, 3-dibutylamino-7-(2-chloroanilino)fluoran, 3-diethylamino-7-(2-chloroanilino)fluoran, 3-diethylamino-6-methyl-7-anilinofluoran, 3-dibutylamino-6-methyl-7-anilinofluoran, 3-dipentylamino-6-methyl-7-anilinofluoran, 3-(N-ethyl-N-tolyl)amino-6-methyl-7-anilinofluoran, 3-piperidino-6-methyl-7-anilinofluoran, 3-(N-ethyl-N-tolyl)amino-6-methyl-7-phenethylfluoran, 3-diethylamino-7-(4-nitroanilino)fluoran, 3-(N-methyl-N-propyl)amino-6-methyl-7-anilinofluoran, 3-(N-ethyl-N-isoamyl)amino-6-methyl-7-anilinofluoran, 3-(N-methyl-N-cyclohexyl)amino-6-methyl-7-anilinofluoran, 3-(N-ethyl-N-tetrahydrofurfuryl)amino-6-methyl-7-anilinofluoran, 3-diethylamino-6-methyl-7-(3-trifluoromethylanilino)fluoran, and the like;

(4) Thiazine Compounds benzoyl leucomethylene blue, p-nitrobenzoyl leucomethylene blue, and the like; and (5) Spiro Compounds 3-methylspirodinaphthopyran, 3-ethylspirodinaphthopyran, 3,3'-dichlorospirodinaphthopryan, 3-benzylspirodinaphthopyran, 3-methylnaphtho-(3-methoxybenzo)spiropyran, 3-propylspirobenzopyran, and the like.

As needed, these dye precursors can be used alone or as a mixture of two or more kinds thereof.

The electron-accepting compound contained as a color developer in the heat-sensitive recording layer is not particularly limited, and may be, for example, any acidic substance generally used in pressure-sensitive recording materials and thermal recording materials. Examples thereof include phenol derivatives, aromatic carboxylic acid derivatives, N,N'-diarylthiourea derivatives, arylsulfonylurea derivatives, polyvalent metal salts such as zinc salts of organic compounds, benzenesulfonamide derivatives and urea-urethane compounds.

Specific examples of the electron-accepting compound contained in the heat-sensitive recording layer are listed below, but are not necessarily limited to the following compounds:

4-hydroxy-4'-isopropoxy diphenylsulfone, 4-hydroxy-4'-n-propoxy diphenylsulfone, 4,4'-dihydroxy diphenylsulfone, 2,4'-dihydroxy diphenylsulfone, 4-hydroxy diphenylsulfone, 4-hydroxy-4'-methyl diphenylsulfone, 4-hydroxy-4'-methoxy diphenylsulfone, 4-hydroxy-4'- ethoxy diphenylsulfone, 4-hydroxy-4'-n-butoxy diphenylsulfone, 4-hydroxy-4'-benzyloxy diphenylsulfone, bis(4-hydroxyphenyl)sulfone monoallyl ether, bis(3-allyl-4-hydroxyphenyl)sulfone, bis(3,5-dibromo-4-hydroxyphenyl)sulfone, bis(3,5-dichloro-4-hydroxyphenyl)sulfone, 3,4-dihydroxy diphenylsulfone, 3,4-dihydroxy-4'-methyl diphenylsulfone, 3,4,4'-trihydroxy diphenylsulfone, 4,4'-[oxybis(ethyleneoxy-p-phenylenesulfonyl)]diphenol, 3,4,3',4'-tetrahydroxy diphenylsulfone, 2,3,4-trihydroxy diphenylsulfone, 3-phenylsulfonyl-4-hydroxy diphenylsulfone, 2,4-bis(phenylsulfonyl)phenol, 4-phenylphenol, 4-hydroxyacetophenone, 1,1-bis(4-hydroxyphenyl)propane, 1,1-bis(4-hydroxyphenyl)pentane, 1,1-bis(4-hydroxyphenyl)hexane, 1,1-bis(4-hydroxyphenyl)cyclohexane, 2,2-bis(4-hydroxyphenyl)propane, 2,2-bis(4-hydroxyphenyl)hexane, 1,1-bis(4-hydroxyphenyl)-2-ethylhexane, 2,2-bis(3-chloro-4-hydroxyphenyl)propane, 1,1-bis(4-hydroxyphenyl)-1-phenylethane, 1,3-bis[1-(4-hydroxyphenyl)-1-methylethyl]benzene, 1,3-bis[1-(3,4-dihydroxyphenyl)-1-methylethyl]benzene, 1,4-bis[1-(4-hydroxyphenyl)-1-methylethyl]benzene, 4,4'-dihydroxy diphenyl ether, 3,3'-dichloro-4,4'-dihydroxydiphenyl sulfide, bis(2-hydroxynaphthyl)methane, methyl 2,2-bis(4-hydroxyphenyl)acetate, butyl 2,2-bis(4-hydroxyphenyl)acetate, 4,4-thiobis(2-tert-butyl-5-methylphenol), dimethyl 4-hydroxyphthalate, benzyl 4-hydroxybenzoate, methyl 4-hydroxybenzoate, benzyl gallate, stearyl gallate, pentaerythritol tetra(4-hydroxybenzoate), pentaerythritol tri(4-hydroxybenzoate), N-butyl-4-[3-(p-toluenesulfonyl)ureido]benzoate, dehydration-condensation products from a polycondensate of 2,2-bis(hydroxymethyl)-1,3-propanediol and 4-hydroxybenzoic acid, N,N'-diphenylthiourea, 4,4'-bis[3-(4-methylphenylsulfonyl)ureido]diphenylmethane, N-(4-methylphenylsulfonyl)-N'-phenylurea, N-(benzenesulfonyl)-N'-[3-(4-toluenesulfonyloxy)phenyl]urea, N-(4-toluenesulfonyl)-N'-[3-(4-toluenesulfonyloxy)phenyl]-urea, urea-urethane compounds, salicylanilide, 5-chlorosalicylanilide, salicylic acid, 3,5-di-tert-butylsalicylic acid, 3,5-bis(α-methylbenzyl)salicylic acid, 4-[2'-(4-methoxyphenoxy)ethyloxy]salicylic acid, 3-(octyloxycarbonylamino)salicylic acid, or metal salts of these salicylic acid derivatives (for example, zinc salts thereof), N-(4-hydroxyphenyl)-4-toluenesulfonamide, N-(2-hydroxyphenyl)-4-toluenesulfonamide, N-phenyl-4-hydroxybenzenesulfonamide, and the like.

The heat-sensitive recording layer can contain a heat-fusible substance as a sensitizer for improvement in thermal responsiveness. For this purpose, the melting point of the heat-fusible substance used is preferably 60 to 180° C., and particularly preferably 80 to 140° C.

The specific examples include known heat-fusible substances such as stearamide, palmitamide, behenamide, N-hydroxymethyl stearamide, N-stearyl stearamide, ethylenebis(stearamide), methylenebis(stearamide), methylol stearamide, N-stearyl urea, benzyl-2-naphthyl ether, m-terphenyl, 4-benzylbiphenyl, 2,2'-bis(4-methoxyphenoxy)diethyl ether, α,α'-diphenoxy-o-xylene, bis(4-methoxyphenyl)ether, diphenyl adipate, dibenzyl oxalate, bis(4-methylbenzyl) oxalate, bis(4-chlorobenzyl) oxalate, dimethyl terephthalate, dibenzyl terephthalate, phenyl benzenesulfonate, bis(4-allyloxyphenyl)sulfone, 1,2-bis(3-methylphenoxy)ethane, 1,2-diphenoxyethane, 4-acetylacetophenone, acetoacetanilides and fatty acid anilides. More preferred are higher fatty acid amides because they can also serve as a lubricant.

These compounds may be used alone or in a combination of two or more kinds thereof. For sufficient thermal responsiveness, it is preferred that the sensitizer content is 5 to 50% by mass relative to the total solid content of the heat-sensitive recording layer.

If needed, for example, for the purpose of increasing color developing sensitivity, the thermal recording material of the present invention can comprise one or more intermediate layers between the support and the heat-sensitive recording layer. Further, the thermal recording material of the present invention can comprise one or more backcoat layers, such as magnetic recording layers, antistatic layers and adhesive layers, on the back side of the support, i.e., the opposite side of the support from the heat-sensitive recording layer.

The layer(s) other than the above-described protective layer, for example, the support and the optional layers (for example, an intermediate layer and a backcoat layer) can also contain a pigment together with an adhesive. Examples of the pigment include inorganic pigments such as diatomite, talc, kaolin, calcined kaolin, heavy calcium carbonate, light calcium carbonate, magnesium carbonate, zinc oxide, aluminum oxide, aluminum hydroxide, magnesium hydroxide, titanium dioxide, barium sulfate, zinc sulfate, amorphous silica, amorphous calcium silicate and colloidal silica; and organic pigments such as melamine resins, urea-formalin resins, polyethylene, nylon, styrene plastic pigments, acrylic plastic pigments and hydrocarbon plastic pigments. Particularly, as the pigment used for the intermediate layer, calcined kaolin and/or hollow sphere organic pigments are preferred because both of them can enhance heat insulation of the intermediate layer and thereby provide thermal recording materials with excellent thermal responsiveness. In the case of use of hollow sphere organic pigments in the intermediate layer, the following effects are expected. Firstly, hollow sphere organic pigments can contain air in the hollow, and thereby enhance heat insulation of the intermediate layer. Secondly, hollow sphere organic pigments, due to their approximately spherical particle form, can be densely arranged without impairing the flexibility of the layer, and thereby increase both strength and flexibility of the intermediate layer. Therefore, hollow sphere organic pigments can provide thermal recording materials with excellent thermal responsiveness and surface strength. The hollow sphere organic pigment as used herein refers to a resin pigment having a closed space therein, and more specifically, a homopolymer having, as a main component, a monomer unit such as vinyl chloride, vinylidene chloride, vinyl acetate, styrene, methyl acrylate, ethyl acrylate, butyl acrylate, acrylonitrile, methyl methacrylate, ethyl methacrylate, butyl methacrylate and methacrylonitrile; a copolymer having two or more kinds of the foregoing monomer units; or the like. The hollow sphere organic pigment used for the present invention is not particularly limited as long as the effects of the present invention can be achieved, but preferred is a hollow sphere organic pigment with an average particle diameter of 0.1 to 5.0 μm, and more preferably 0.5 to 2.0 μm. Here, the average particle diameter is determined by particle size distribution measurement using laser diffraction. The hollow sphere organic pigment content is preferably 3 to 80% by mass relative to the total solid content of the intermediate layer.

The support and the optional layers (for example, an intermediate layer and a backcoat layer) may contain any kind of resin as an adhesive. Specific examples of the resin include starch, hydroxyethyl cellulose, methyl cellulose, ethyl cellulose, carboxymethyl cellulose, gelatin, casein, polyvinyl alcohol, modified polyvinyl alcohols, polyacrylic acid, polymethacrylic acid, polyacrylic acid esters, polymethacrylic acid esters, sodium polyacrylate, polyethylene terephthalate, polybutylene terephthalate, chlorinated polyether, allyl resins, furan resins, ketone resins, oxybenzoylpolyester, polyacetal, polyether ether ketone, polyether sulfone, polyimide, polyamide, polyamideimide, polyaminobismaleimide, polymethylpentene, polyphenylene oxide, polyphenylene sulfide, polyphenylene sulfone, polysulfone, polyarylate, polyallylsulfone, polybutadiene, polycarbonate, polyethylene, polypropylene, polystyrene, polyvinyl chloride, polyvinylidene chloride, polyvinyl acetate, polyurethane, phenol resins, urea resins, melamine resins, melamine-formalin resins, benzoguanamine resins, bismaleimide-triazine resins, alkyd resins, amino resins, epoxy resins, unsaturated polyester resins, styrene/butadiene copolymers, acrylonitrile/butadiene copolymers, methyl acrylate/butadiene copolymers, ethylene/vinyl acetate copolymers, acrylamide/acrylic acid ester copolymers, acrylamide/acrylic acid ester/methacrylic acid terpolymers, alkali salts of styrene/maleic anhydride copolymers, alkali or ammonium salts of ethylene/maleic anhydride copolymers, and various polyolefin resins.

The protective layer and/or the heat-sensitive recording layer preferably contain a lubricant such as higher fatty acid metal salts, higher fatty acid amides, paraffin, polyolefin, oxidized polyethylene and castor wax for improvement in anti-sticking property etc. The lubricant content is preferably 5 to 50% by mass relative to the total solid content of the protective layer or the heat-sensitive recording layer. If needed, the protective layer and/or the heat-sensitive recording layer may contain ultraviolet absorbers such as benzophenone or benzotriazole compounds for improvement in light resistance etc.; surfactants such as high-molecular-weight anionic or nonionic surfactants as a dispersing and wetting agent; and in addition, fluorescent dyes, defoamants, etc.

As the support of the present invention, any material selected from paper, various woven cloths, a nonwoven cloth, a synthetic resin film, a synthetic resin laminated paper, a synthetic paper, a metallic foil, a vapor deposition sheet and a composite sheet having the foregoing materials combined by adhesion etc., can be used depending on the purpose. Among these, paper, such as acid-free paper and acid paper, is preferably used because the water content is easy to control.

The heat-sensitive recording layer, the intermediate layer and the backcoat layer can be formed according to a known technique without any particular limitation. Specifically, a coating liquid is applied by a technique selected from film press coating, air knife coating, rod blade coating, bar coating, blade coating, gravure coating, curtain coating, extrusion bar coating and the like, and then dried to form the objective layer. Alternatively, layer formation may be achieved with the use of various printers etc. such as lithographic printers, letterpress printers, flexographic printers, gravure printers, screen printers and hotmelt printers. Furthermore, for layer formation, any of the following procedures may be employed: a set of coating and drying is repeated for forming each layer; after successive coating for forming all the layers (wet-on-wet), drying is performed; and after simultaneous coating for forming all the layers (simultaneous multilayer coating by slide curtain coating), drying is performed. For sufficient thermal responsiveness, the coating amount for forming the heat-sensitive recording layer is preferably 0.05 to 2.0 g/m$^2$, and more preferably 0.1 to 1.0 g/m$^2$ in terms of the bone-dry coating amount of the dye precursor. The bone-dry coating amount for forming the intermediate layer is preferably 1 to 30 g/m$^2$, and more preferably 3 to 20 g/m$^2$. The bone-dry coating amount for forming the backcoat layer is appropriately selected depending on the function required of the backcoat layer, and the like.

If needed, after coating for formation of the intermediate layer, the heat-sensitive recording layer, the protective layer or the backcoat layer, supercalendering may be performed. This processing makes the coating surface smooth and thereby can improve print quality of thermal recording materials.

EXAMPLES

Hereinafter, the present invention will be illustrated in more detail by reference to Examples, but is not limited thereto. In the following Examples, "part(s)" and "%" are each on the mass basis, and the coating amount denotes a bone-dry coating amount. In the formulae of coating liquids, numerical values expressed in percentage (%) denote the concentrations of substantial components, such as solids, in media.

Example 1

(1) Preparation of Coating Liquid for Forming Intermediate Layer

A mixture of 50 parts of calcined kaolin (manufactured by BASF, trade name: Ansilex), 100 parts of a 27.5% aqueous dispersion of hollow sphere organic pigment particles (manufactured by Rohm & Haas Company, trade name: HP91, styrene acrylic resin pigment), 40 parts of a 50% aqueous styrene/butadiene latex, 50 parts of a 10% aqueous oxidized starch solution, and 100 parts of water was stirred, to give a coating liquid for forming the intermediate layer.

(2) Preparation of Coating Liquid for Forming Heat-Sensitive Recording Layer—Part 1—

The mixtures (A), (B) and (C) shown below were separately ground by Dyno-Mill (a sand mill manufactured by WAB) so that the average particle diameter was 1 μm or less, to give the objective dispersions.

| (A) Dye precursor dispersion | |
|---|---|
| 3-Dibutylamino-6-methyl-7-anilinofluoran | 30 parts |
| 2.5% Aqueous sulfone-modified polyvinyl alcohol solution | 69 parts |
| 1% Aqueous acetyleneglycol surfactant solution | 1 part |

| (B) Electron-accepting compound dispersion | |
|---|---|
| 4-Hydroxy-4'-isopropoxy diphenylsulfone | 30 parts |
| 2.5% Aqueous sulfone-modified polyvinyl alcohol solution | 69 parts |
| 1% Aqueous acetyleneglycol surfactant solution | 1 part |

| (C) Pigment and sensitizer dispersion | |
|---|---|
| Aluminum hydroxide (manufactured by Showa Denko K.K., trade name: HIGILITE H42) | 50 parts |
| 1,2-Bis(3-methylphenoxy)ethane | 30 parts |
| 2.5% Aqueous sulfone-modified polyvinyl alcohol solution | 199 parts |
| 1% Aqueous acetyleneglycol surfactant solution | 1 part |

(3) Preparation of Coating Liquid for Forming Heat-Sensitive Recording Layer—Part 2—

Next, the dispersions (A), (B) and (C) and the other components shown below were mixed with stirring, to give a coating liquid for forming the heat-sensitive recording layer.

| | |
|---|---|
| (A) Dye precursor dispersion | 100 parts |
| (B) Electron-accepting compound dispersion | 100 parts |
| (C) Pigment and sensitizer dispersion | 280 parts |
| 30% Aqueous zinc stearate dispersion (manufactured by Chukyo Yushi Co., Ltd., trade name: Z-7-30) | 25 parts |
| 40% Aqueous methylol stearamide dispersion | 25 parts |
| 20% Aqueous paraffin wax dispersion | 25 parts |
| 10% Aqueous solution of fully-saponified polyvinyl alcohol (manufactured by KURARAY CO., LTD., trade name: PVA117) | 200 parts |
| Water | 100 parts |

(4) Preparation of Calcium Glyoxylate

Calcium glyoxylate can be produced according to a known method. Examples of the known method include neutralization of glyoxylic acid, salt exchange reaction between glyoxylic acid and a salt of an acid with an acid dissociation constant greater than that of glyoxylic acid, and alkaline hydrolysis of glyoxylic acid esters. In this Example, calcium glyoxylate was produced in the following manner: an aqueous calcium acetate solution was added to an aqueous glyoxylic acid solution, and the resulting white crystals were collected by filtration, washed with water and dried. As a result, calcium glyoxylate particles which have an average diameter of 300 μm and partly remain on a mesh with 1000-μm openings and a mesh with 500-μm openings when sieved were obtained. The obtained calcium glyoxylate particles were dry ground in Turbo Mill manufactured by FREUND-TURBO CORPORATION, and thereby calcium glyoxylate particles which have an average diameter of 100 μm and pass through a mesh with 1000-μm openings and a mesh with 500-μm openings when sieved were obtained.

(5) Preparation of Coating Liquid for Forming Protective Layer

A coating liquid for forming the protective layer was prepared by mixing the components in the ratio described below. The mixing was performed with stirring using a homo mixer at 30° C. for 60 minutes.

| | |
|---|---|
| 10% Aqueous solution of acetoacetyl-modified polyvinyl alcohol (manufactured by The Nippon Synthetic Chemical Industry Co., Ltd., trade name: Z-200 (average polymerization degree: about 1100, saponification degree: 99.0%)) | 50 parts |
| 20% Aqueous dispersion of kaolin (manufactured by BASF, trade name: UW90) | 20 parts |
| 30% Aqueous zinc stearate dispersion (manufactured by Chukyo Yushi Co., Ltd., trade name: Z-7-30) | 6 parts |
| Calcium glyoxylate | 0.25 part |
| Water | 30 parts |

(6) Production of Thermal Recording Material

On an acid-free high-quality roll paper with a basis weight of 66 g/m$^2$, the above-prepared coating liquids were applied by an air-knife coater and dried by an air floating drier, so that the solid coating amount was 5 g/m$^2$ for the intermediate layer, 0.5 g/m$^2$ for the heat-sensitive recording layer in terms of the dye precursor, and 3 g/m$^2$ for the protective layer. Then, calendering was performed. In this way, a thermal recording material was prepared.

Example 2

A thermal recording material was obtained in the same manner as described in Example 1, except for the following procedures: in (4) Preparation of calcium glyoxylate, the time of dry grinding in Turbo Mill manufactured by FREUND-TURBO CORPORATION was extended, and thereby calcium glyoxylate particles which have an average diameter of 70 μm and pass through a mesh with 1000-μm openings and a mesh with 500-μm openings when sieved were obtained; and these calcium glyoxylate particles were used in (5) Preparation of coating liquid for forming protective layer.

Example 3

A thermal recording material was obtained in the same manner as described in Example 1, except for using 50 parts of a 10% aqueous solution of acetoacetyl-modified polyvinyl alcohol (manufactured by The Nippon Synthetic Chemical Industry Co., Ltd., trade name: Z-410 (average polymerization degree: about 2300, saponification degree: 98.0%)), instead of 50 parts of the 10% aqueous solution of acetoacetyl-modified polyvinyl alcohol (manufactured by The Nippon Synthetic Chemical Industry Co., Ltd., trade name: Z-200) in (5) Preparation of coating liquid for forming protective layer.

Example 4

A thermal recording material was obtained in the same manner as described in Example 1, except for adding 1 part of a 25% aqueous solution of polyamide-epichlorohydrin resin (manufactured by SEIKO PMC CORPORATION, trade name: WS4020) in (5) Preparation of coating liquid for forming protective layer.

Example 5

A thermal recording material was obtained in the same manner as described in Example 1, except for adding 1.25 parts of a 20% aqueous solution of polyamine-epichlorohydrin resin (manufactured by SEIKO PMC CORPORATION, trade name: WS4010) in (5) Preparation of coating liquid for forming protective layer.

Comparative Example 1

A thermal recording material was obtained in the same manner as described in Example 1, except for using calcium glyoxylate particles that had not been subjected to dry grinding, instead of the calcium glyoxylate particles dry-ground in Turbo Mill manufactured by FREUND-TURBO CORPORATION in (5) Preparation of coating liquid for forming protective layer.

Comparative Example 2

A thermal recording material was obtained in the same manner as described in Example 1, except for the following procedures: in (4) Preparation of calcium glyoxylate, the time of dry grinding in Turbo Mill manufactured by FREUND-TURBO CORPORATION was shortened, and thereby calcium glyoxylate particles which have an average diameter of 250 μm and pass through a mesh with 1000-μm openings but partly remain on a mesh with 500 μm openings when sieved were obtained; and these calcium glyoxylate particles were used in (5) Preparation of coating liquid for forming protective layer.

Comparative Example 3

A thermal recording material was obtained in the same manner as described in Example 1, except for the following procedures: in (4) Preparation of calcium glyoxylate, the time of dry grinding in Turbo Mill manufactured by FREUND-TURBO CORPORATION was shortened, and thereby calcium glyoxylate particles which have an average diameter of 150 μm and pass through a mesh with 1000-μm openings and a mesh with 500-μm openings when sieved were obtained; and these calcium glyoxylate particles were used in (5) Preparation of coating liquid for forming protective layer.

Comparative Example 4

A thermal recording material was obtained in the same manner as described in Example 1, except for using 0.25 part of adipic acid dihydrazide, instead of 0.25 part of calcium glyoxylate in (5) Preparation of coating liquid for forming protective layer.

Comparative Example 5

A thermal recording material was obtained in the same manner as described in Example 1, except for using 0.625 part of a 40% aqueous glyoxal solution, instead of 0.25 part of calcium glyoxylate in (5) Preparation of coating liquid for forming protective layer.

Comparative Example 6

A thermal recording material was obtained in the same manner as described in Example 1, except for using 2.5 parts of a 10% aqueous sodium glyoxylate solution, instead of 0.25 part of calcium glyoxylate in (5) Preparation of coating liquid for forming protective layer.

Comparative Example 7

A thermal recording material was obtained in the same manner as described in Example 1, except for using 0.5 part of a 50% aqueous magnesium glyoxylate solution, instead of 0.25 part of calcium glyoxylate in (5) Preparation of coating liquid for forming protective layer.

Undissolved calcium glyoxylate was not observed in any of the coating liquids for forming the protective layer prepared in Examples 1 to 5 and Comparative Examples 1 to 3.

The thermal recording materials produced in Examples 1 to 5 and Comparative Examples 1 to 7 were evaluated as below. The results are shown in Table 1.

<Print Density>

On each of the produced thermal recording materials, printing was performed with the use of a facsimile tester TH-PMD (manufactured by Okura Engineering Co., LTD.). The tester was equipped with a thermal print head featuring a dot density of 8 dots/mm and a print head resistance of 1,685Ω. Black solid printing and letter printing were performed at an applied voltage of 20 V and at an applied pulse-width of 1.0 msec. The print density was measured with Macbeth reflection densitometer model RD-918 (visual filter) (manufactured by Macbeth). The print density is practically required to be 1.0 or more, and is preferably 1.2 or more.

<Water Resistance>

From each thermal recording material, two sample pieces sized 5 cm×5 cm were prepared. One milliliter of pure water was put on the protective layer surface of one of the pieces, and the other piece was overlaid thereon so that both protective layer surfaces faced each other. On top of that, a 3-kg weight was put, and the combined pieces were kept under load in an atmosphere of ordinary temperature and humidity for 24 hours. Then, the both pieces were manually detached from each other and the degree of sticking of the protective layers was evaluated as a measure of water resistance. The evaluation criterion used is as follows.

Very good: The protective layer surfaces spontaneously separate from each other.

Good: The protective layer surfaces are stuck together but easily separable from each other, and thus the thermal recording material pieces can be easily detached from each other.

Very poor: The protective layer surfaces are stuck together, and the thermal recording material pieces are difficult to detach from each other and become torn.

<Discoloration Resistance>

Each thermal recording material was allowed to stand in an atmosphere of 50° C. and 90% RH for 24 hours, and in the non-printing area, the b* value as specified in JIS Z 8729 was measured with a colorimeter PF10 manufactured by Nippon Denshoku Industries Co., LTD. The evaluation criterion used is as follows.

Very good: The b* value is lower than 2.0.

Good: The b* value is 2.0 or higher but lower than 3.0.

Very poor: The b* value is 3.0 or higher, which is a practically unacceptable level.

<Stability of Coating Liquid for Forming Protective Layer>

The coating liquids for forming the protective layer were separately prepared and then kept under stirring at ordinary temperature and humidity for 72 hours. Afterwards, the state of each coating liquid was visually evaluated. The evaluation criterion used is as follows.

Very good: The state of the coating liquid has hardly changed, and the coating liquid can be applied without any trouble.

Good: The coating liquid has become viscous, but can be applied after diluted.

Very poor: The coating liquid has become coagulated and cannot be applied.

<Prevention of Print Head Wear>

On each thermal recording material, printing was continuously performed using a printer TM-T88II manufactured by Seiko Epson Corp. until the length of the printed area reached 20 km. Afterwards, the thermal print head was observed with the use of a laser microscope VK-8500 manufactured by KEYENCE CORPORATION, and evaluated for wear. The evaluation criterion used is as follows.

Good: Wear of the print head is hardly observed.

Poor: Slight wear of the print head is observed and is a practically unacceptable level.

Very poor: Extensive wear of the print head is observed, and even print failure is observed.

TABLE 1

| | Print density | Water resistance | Discoloration resistance | Stability of coating liquid for forming protective layer | Prevention of print head wear |
|---|---|---|---|---|---|
| Ex. 1 | 1.34 | Good | Good | Good | Good |
| Ex. 2 | 1.35 | Very good | Good | Good | Good |
| Ex. 3 | 1.40 | Good | Good | Good | Good |
| Ex. 4 | 1.33 | Very good | Very good | Very good | Good |
| Ex. 5 | 1.34 | Very good | Very good | Good | Good |
| Com. Ex. 1 | 1.30 | Very poor | Good | Good | Poor |
| Com. Ex. 2 | 1.32 | Very poor | Good | Good | Poor |
| Com. Ex. 3 | 1.33 | Very poor | Good | Good | Good |
| Com. | 1.35 | Good | Very poor | Very poor | Good |

TABLE 1-continued

| | Print density | Water resistance | Discoloration resistance | Stability of coating liquid for forming protective layer | Prevention of print head wear |
|---|---|---|---|---|---|
| Ex. 4 | | | | | |
| Com. Ex. 5 | 1.33 | Very good | Very poor | Very poor | Poor |
| Com. Ex. 6 | 1.32 | Good | Good | Good | Very poor |
| Com. Ex. 7 | 1.31 | Very poor | Good | Good | Poor |

Ex.: Example
Com. Ex.: Comparative Example

As clearly shown in Table 1, according to the present invention, thermal recording materials that are excellent in water resistance and prevention of print head wear, less prone to discoloration in the non-printing area, and stably producible can be obtained.

The invention claimed is:

1. A thermal recording material comprising, as essential layers, a heat-sensitive recording layer for color formation by heat and a protective layer stacked in this order on a support, the protective layer being formed by applying a coating liquid for forming the protective layer, the coating liquid being prepared by mixing an acetoacetyl-modified polyvinyl alcohol and calcium glyoxylate particles with a maximum diameter less than 500 μm and an average diameter of 125 μm or less.

2. The thermal recording material according to claim 1, wherein the coating liquid for forming the protective layer further contains an epichlorohydrin resin.

3. The thermal recording material according to claim 1 or 2, wherein the average diameter of the calcium glyoxylate particles is 85 μm or less.

4. A method for producing a thermal recording material comprising, as essential layers, a heat-sensitive recording layer for color formation by heat and a protective layer stacked in this order on a support, the method comprising the steps of: preparing a coating liquid for forming the protective layer by mixing an acetoacetyl-modified polyvinyl alcohol and calcium glyoxylate particles with a maximum diameter less than 500 μm and an average diameter of 125 μm or less, and applying the coating liquid to form the protective layer.

5. The method according to claim 4, wherein the coating liquid for forming the protective layer further contains an epichlorohydrin resin.

6. The method according to claim 4 or 5, wherein the average diameter of the calcium glyoxylate particles is 85 μm or less.

* * * * *